US008146656B2

(12) United States Patent
Brown

(10) Patent No.: US 8,146,656 B2
(45) Date of Patent: Apr. 3, 2012

(54) METHOD TO MEASURE INJECTOR INFLOW PROFILES

(75) Inventor: George A. Brown, Buckinghamshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/196,707

(22) Filed: Aug. 2, 2011

(65) Prior Publication Data

US 2011/0284217 A1 Nov. 24, 2011

Related U.S. Application Data

(63) Continuation of application No. 10/551,288, filed on Sep. 28, 2005, now Pat. No. 8,011,430.

(51) Int. Cl.
*E21B 47/06* (2006.01)

(52) U.S. Cl. ..... 166/250.01; 166/250.02; 166/272.6

(58) Field of Classification Search ..... 166/250.01, 166/250.02, 268, 400, 272.6, 272.7, 303
See application file for complete search history.

(56) References Cited

U.S. PATENT DOCUMENTS 3,709,032 A 1/1973 Coles, Jr. et al.
3,795,142 A * 3/1974 Smith et al. ..... 73/152.13
4,622,463 A 11/1986 Hill
4,832,121 A * 5/1989 Anderson ..... 166/250.09
6,004,639 A * 12/1999 Quigley et al. ..... 428/36.3
6,116,085 A * 9/2000 Moffatt et al. ..... 73/152.46
6,176,323 B1 1/2001 Weirich et al.
6,497,279 B1 12/2002 Williams et al.
6,997,256 B2 2/2006 Williams et al.
7,536,905 B2 * 5/2009 Jalali et al. ..... 73/152.33

FOREIGN PATENT DOCUMENTS

WO 0175403 A1 10/2001
WO 2004076815 A1 9/2004

OTHER PUBLICATIONS

T.J. Nowak—The Estimation of Water Injection Profiles from Temperature Surveys—Petroleum Transations, AIME, vol. 198, 1953—pp. 203-212, Paper presented at the West Coast Fall Meeting of the Petroleum Branch in Los Angeles, California, Oct. 23-24, 1952.

* cited by examiner

*Primary Examiner* — Kenneth L Thompson
(74) *Attorney, Agent, or Firm* — Brandon S. Clark; Rodney Warfford

(57) ABSTRACT

A method of determining the inflow profile of an injection wellbore, comprising stopping injection of fluid into a formation, the formation intersected by a wellbore having a section uphole of the formation and a section within the formation, monitoring temperature at least partially along the uphole section of the wellbore and at least partially along the formation section of the wellbore, injecting fluid into the formation once the temperature in the uphole section of the wellbore increases, and monitoring the movement of the increased temperature fluid as it moves from the uphole section of the wellbore along the formation section of the wellbore. The monitoring may be performed using a distributed temperature sensing system.

14 Claims, 2 Drawing Sheets

METHOD TO MEASURE INJECTOR INFLOW PROFILES

CROSS REFERENCE

This application claims benefit to U.S. Provisional Application No. 60/458,867 filed on Mar. 28, 2003; International Application No. PCT/GB2004/001084 filed on Mar. 12, 2004; and U.S. Pat. No. 8,011,430 issued on Sep. 6, 2011, incorporated by reference herein.

BACKGROUND OF THE INVENTION

1. Field of the Invention

The invention generally relates to a method for use in subterranean wellbores. More particularly, the invention relates to a method used to measure inflow profiles in subterranean injector wellbores.

2. Description of Related Art

It is important for an operator of a subterranean injector wellbore, such as for an oil or gas well, to determine the inflow profile of the injector wellbore in order to analyze whether all or just certain parts of a specific zone are injecting fluids therethrough. This determination and analysis is useful in vertical, deviated, and horizontal wellbores. In horizontal wellbores, the amount of fluid flowing through a specific zone tends to decrease from the heel to the toe of the well. Often, the toe and sections close to the toe have very little and sometimes no fluid flowing therethrough. An operator with knowledge of the inflow profile of a well can then attempt to take remediation measures to ensure that a more even inflow profile is created from the heel to the toe of the well.

Thus, there exists a continuing need for an arrangement and/or technique that addresses one or more of the problems that are stated above.

BRIEF SUMMARY OF THE INVENTION

The invention comprises a method of determining the inflow profile of an injection wellbore, comprising stopping injection of fluid into a formation, the formation intersected by a wellbore having a section uphole of the formation and a section within the formation, monitoring temperature at least partially along the uphole section of the wellbore and at least partially along the formation section of the wellbore, injecting fluid into the formation once the temperature in the uphole section of the wellbore increases, and monitoring the movement of the increased temperature fluid as it moves from the uphole section of the wellbore along the formation section of the wellbore. The monitoring may be performed using a distributed temperature sensing system.

BRIEF DESCRIPTION OF THE DRAWINGS

The invention is more fully described with reference to the appended drawings wherein:

FIG. 3 is a plot showing temperature profiles taken along a wellbore at different points in time, including during injection and while the well is shut-in;

DETAILED DESCRIPTION OF THE INVENTION

Figure 1:
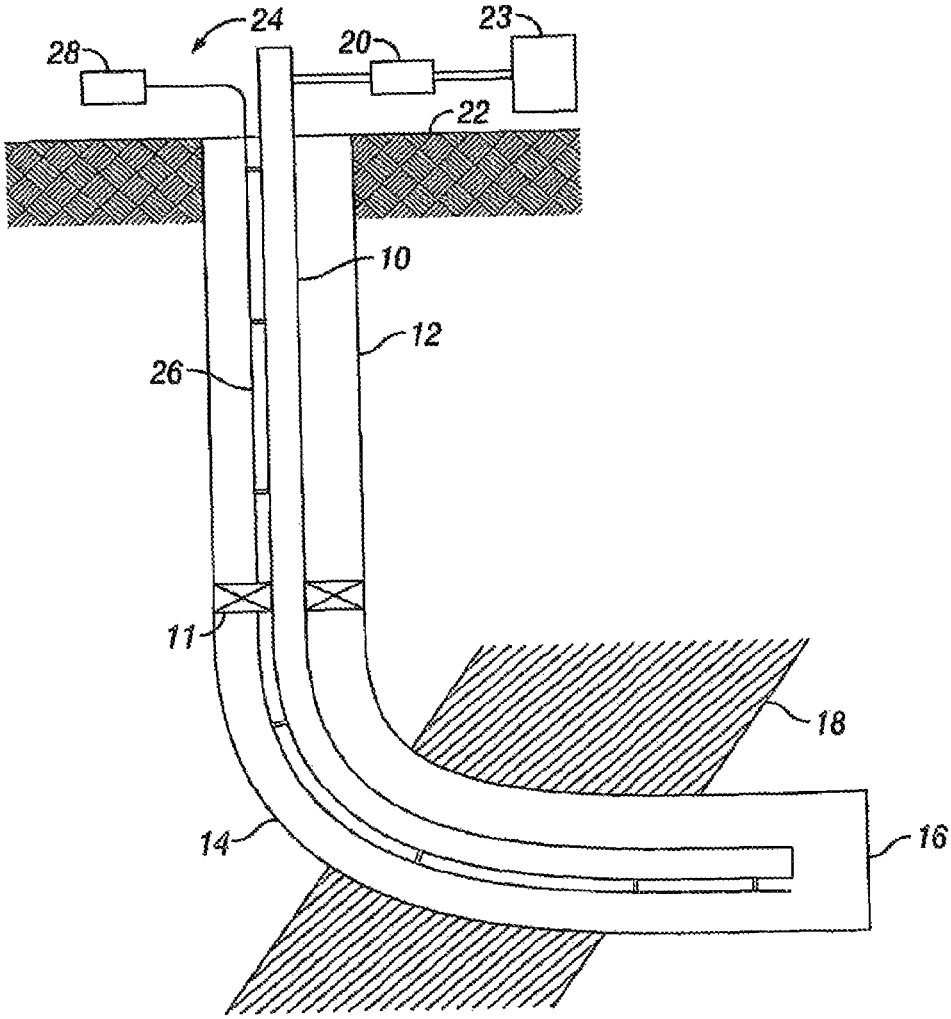
FIG. 1 is a schematic illustration of a wellbore utilizing the present invention.

FIG. 1 is a general schematic of an injector wellbore utilizing the present invention. A tubing 10 is disposed within a wellbore 12 that may be cased or uncased. Wellbore 12 may be a horizontal or inclined well that has a heel 14 and a toe 16, or a vertical well. The horizontal section of the well may have a liner, may be open-hole, or may have a continuation of tubing 10 therein. Wellbore 12 intersects a permeable formation 18 such as a hydrocarbon formation. A packer 11 may be disposed around the tubing 10 to sealingly separate the wellbore sections above and below the packer 11.

Wellbore 12 is an injector wellbore and the tubing 10 thus has injection equipment 20 (such as a pump) connected thereto near the earth's surface 22. Injection equipment 20 may be connected to a tank 23 containing the fluid which is to be injected into formation 18. Typically, the fluid is injected by the injection equipment 20 through the tubing 10 and into formation 18. Tubing 10 may have ports adjacent formation 18 so as to allow flow of the fluid into formation 18. In other embodiments, a liner with slots disposed in the horizontal section of the well may provide the fluid communication, or the horizontal section may be open hole. Perforations may also be made along formation 18 to facilitate fluid flow into the formation 18.

A distributed temperature sensing (DTS) system 24 is also disposed in the wellbore 12. The DTS system 24 includes an optical fiber 26 and an optical launch and acquisition unit 28.

In the embodiment shown, the optical fiber 26 is disposed along the tubing 10 and is attached thereto on the outside of the tubing 10. In other embodiments, the optical fiber 26 may be disposed within the tubing 10 or outside of the casing of the wellbore 12 (if the wellbore is cased). The optical fiber 26 extends through the packer 11 and across formation 18. The optical fiber 26 may be deployed within a conduit, such as a metal control line. The control line is then attached to the tubing 10 or behind the casing (if the wellbore is cased). The optical fiber 26 may be pumped into the control line by use of fluid drag before or after the control line and tubing 10 are deployed downhole. This pumping technique is described in U.S. Reissue Pat. No. 37,283, which is incorporated herein by reference.

The acquisition unit 28 launches optical pulses through the optical fiber 26 and then receives the return signals and interprets such signals to provide a distributed temperature measurement profile along the length of the optical fiber 26. In one embodiment, the DTS system 24 is an optical time domain reflectometry (OTDR) system wherein the acquisition unit 28 includes a light source and a computer or logic device. OTDR systems are known in the prior art, such as those described in U.S. Pat. Nos. 4,823,166 and 5,592,282, both of which are incorporated herein by reference. In OTDR, a pulse of optical energy is launched into an optical fiber and the backscattered optical energy returning from the fiber is observed as a function of time, which is proportional to distance along the fiber from which the backscattered light is received. This backscattered light includes the Rayleigh, Brillouin, and Raman spectrums. The Raman spectrum is the most temperature sensitive, with the intensity of the spectrum varying with temperature, although Brillouin scattering, and in certain cases Rayleigh scattering, are also temperature sensitive.

Generally, in one embodiment, pulses of light at a fixed wavelength are transmitted from the light source in acquisition unit 28 down the optical fiber 26. At every measurement point in the optical fiber 26, light is back-scattered and returns to the acquisition unit 28. Knowing the speed of light and the moment of arrival of the return signal enables its point of origin along the optical fiber 26 to be determined. Temperature stimulates the energy levels of molecules of the silica and of other index-modifying additives, such as germania, present in the optical fiber 26. The back-scattered light contains upshifted and downshifted wavebands (such as the Stokes Raman and Anti-Stokes Raman portions of the back-scattered spectrum), which can be analyzed to determine the temperature at origin. In this way, the temperature of each of the responding measurement points in the optical fiber 26 can be calculated by the acquisition unit 28, providing a complete temperature profile along the length of the optical fiber 26. In one embodiment, the optical fiber 26 is disposed in a u-shape along the wellbore 12 providing greater resolution to the temperature measurement.

Figure 2:
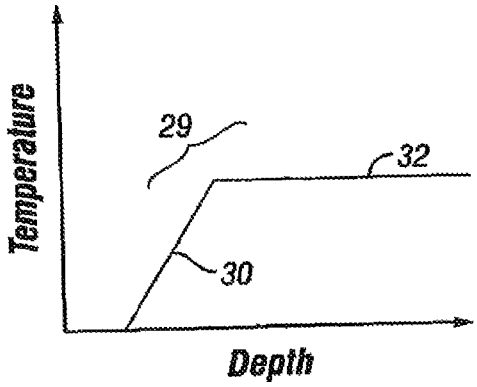
FIG. 2 is a plot of a geothermal temperature profile along a horizontal wellbore.

FIG. 2 shows a graph of the geothermal temperature profile 29 of a generic horizontal wellbore. This profile shows at 30 a gradual increase in temperature as the depth of the well increases, until at 32 a stable temperature is reached along the horizontal section of the wellbore. The geothermal temperature profile is the temperature profile existing in the wellbore without external factors (such as injection). After injection or other external factors end, the wellbore will gradually change in temperature towards the geothermal temperature profile.

Figure 3:
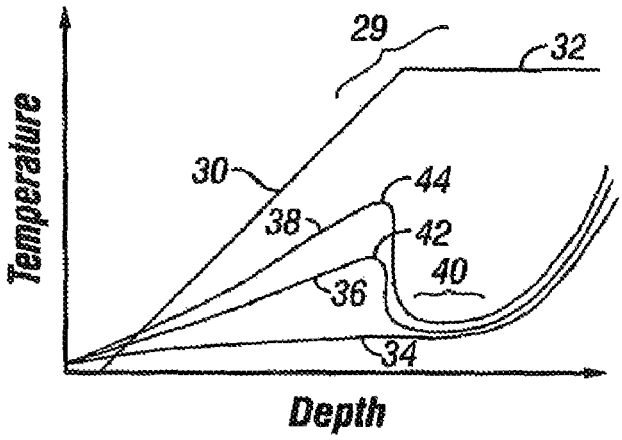

In one embodiment of this invention, in order to determine the inflow profile of a wellbore 12, the wellbore 12 must first be shut-in so that no injection takes place. The temperature profile of the wellbore 12 changes if there is injection and throughout the shut-in period. FIG. 3 shows these changes.

Curve 34 is the temperature profile of the wellbore 12 during injection, wherein the temperature is relatively stable since the injected fluid is flowing through the tubing 10 and into the formation 18.

Curve 36 represents a temperature profile of the wellbore 12 taken after injection is stopped and the well is shut-in. Curve 36 is already gradually moving towards the geothermal profile 29. However, section 40 of curve 36 is changing at a much slower rate than the uphole part of the curve 36 because section 40 represents the area of the formation 18 which absorbed the most fluid during the injection step. Therefore, since this area is in contact with a substantial amount of fluid already injected in the formation 18, this area takes a longer time to heat or return to its geothermal norm. Of interest, peak 42 is present on curve 36 because peak 42 is the area of wellbore 12 found directly before formation 18 (and not taking fluids). Therefore, a substantial temperature difference exists between peak 42 and section 40.

Curve 38 represents a temperature profile of the wellbore 12 taken subsequent to the temperature profile represented by curve 36. Curve 38 shows that the temperature profile is still heating towards the geothermal norm, but that the difference between peak 44 (peak 42 at a later time) and the section 40 are still apparent.

The object of this invention is to determine the velocity of the fluid being injected across the length of the formation 18 in order to then determine the inflow profile of such formation 18. The technique used to achieve this is to re-initiate injection after a relatively short shut-in period and track the movement of the temperature peak (42, 44) by use of the DTS system 24.

Figure 4:
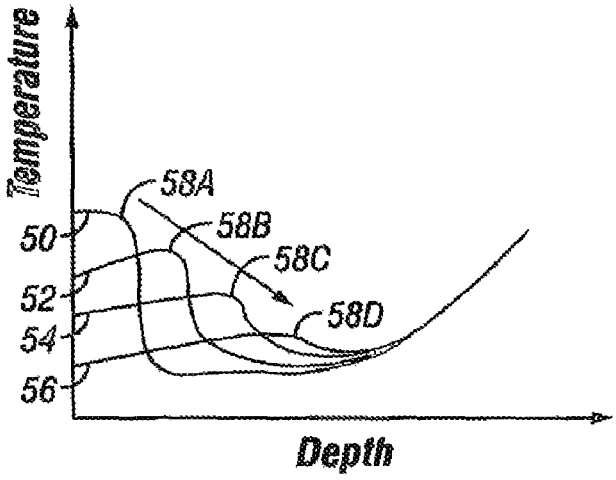
FIG. 4 is a plot illustrating the movement of a temperature peak along the wellbore and relevant formation.

FIG. 4 shows four curves representing temperature profiles taken over time. Curve 50 is a profile taken during shut-in, curve 52 is a profile taken after injection is re-started, curve 54 is a profile taken after curve 52, and curve 56 is a profile taken after curve 54. For purposes of clarity, the entire temperature profile of the wellbore has not been shown. Curve 50 includes a temperature peak 58A that represents the temperature peak present during shut-in and found directly uphole of formation 18. Temperature peak 58A corresponds to temperature peaks 42 and 44 of FIG. 3. Once injection is restarted, the slug of heated fluid represented by temperature peak 58A is essentially "pushed" down the wellbore 12, as is shown by the temperature peaks 58B-D in time lapse curves 52, 54, and 56. The temperature peak 58A-D, as expected, decreases over time once injection is restarted.

Figure 5:
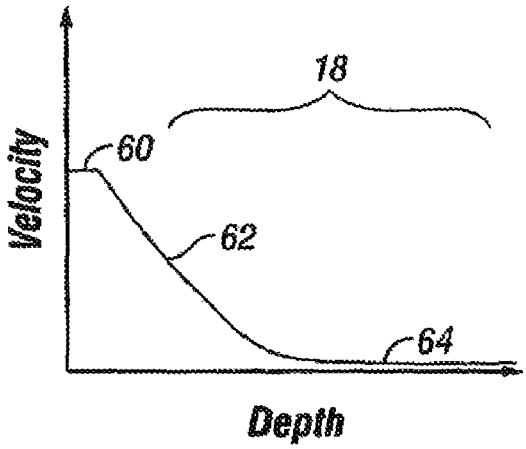
FIG. 5 is a plot of the velocity of the temperature peak of FIG. 4 as it moves along the wellbore and relevant formation.

By tracking the movement of the temperature peak 58A-D down the wellbore 12 (through use of the DTS system 24), an operator can determine the velocity of the temperature peak 58A-D as it moves down the wellbore 12 and the formation 18 over time. As shown in FIG. 5, the velocity of the temperature peak 58A-D is then plotted against depth across the length of the formation 18. This plot shows a constant velocity at 60 immediately prior to the temperature peak reaching the formation 18, a gradual decrease of velocity at 62 as the temperature peak moves away from the uphole boundary of the formation 18, and a very low and perhaps zero velocity as the peak nears the downhole boundary of the formation 18. From this plot, one can determine that the downhole portion of the formation 18 (that closer to the toe 16) is not receiving much fluid during injection in comparison to the uphole portion of the formation 18. With this information, one can provide injection inflow profiles across the formation 18, which profiles can be shown in percentage form (percentage of fluid being injected along the length of the formation 18) or quantitative form (with knowledge or a measurement of the actual surface injection rate). Thus, by monitoring the velocity of a heated slug (temperature peaks 58A-D) across a formation 18, the injection inflow profile of a wellbore 12 across a formation 18 may be determined.

Of importance, the shut-in period required to use the present technique is short in relation to the shut-in periods in some comparable prior art techniques. In some prior art techniques, the area of the formation 18 (see section 40 in FIG. 3) and not the area directly uphole of the formation 18 (see peaks 42 and 44 in FIG. 3) is monitored during the warmback period (and not the injection period) to determine the inflow profile. However, in wellbores that have been injecting for a long period of time, the area of the formation 18 (see section 40) must be monitored for a substantial period of time before the warmback curves begin to move towards the geothermal gradient and the relevant information can be extracted therefrom. With the present technique, the warmback period can be as short as 24 to 48 hours, since the temperature peaks 42 and 44 (used as previously stated) begin to shift towards the geothermal profile much more quickly. Thus, a process that would take weeks or months to complete using the prior art techniques can now be completed in several days using the present technique.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the scope of the invention.

The invention claimed is:

1. A method usable with a wellbore, comprising:

stopping injection of fluid into a formation, the formation intersected by a wellbore having an uphole section uphole of the formation and a formation section within the formation;

observing at least one temperature profile of the fluid in the wellbore;

determining a characteristic of the temperature profile between two points along the profile;

re-starting injection of fluid into the formation;

observing the movement of the temperature characteristic as it moves through the wellbore; and determining an inflow profile of the formation based on the movement of the temperature characteristic that is observed.

2. The method of claim 1, wherein the temperature characteristic is a temperature peak.

3. The method of claim 1, wherein determining the inflow profile comprises computing the velocity of the temperature characteristic along the formation section of the wellbore.

4. The method of claim 3, further comprising plotting the velocity of the temperature characteristic as a function of depth in the formation section of the wellbore.

5. The method of claim 3, wherein the inflow profile indicates the percentage of fluid injected along the length of the formation section of the wellbore.

6. The method of claim 3, wherein determining the inflow profile further comprises:

measuring the injection rate of fluid at the surface; and calculating the inflow profile in quantitative form.

7. The method of claim 1, wherein the temperature observing is performed using an optical fiber to sense distributed temperature along the wellbore.

8. The method of claim 1, wherein one point of the temperature characteristic is located in the uphole section of the formation and another point of the temperature characteristic is located in the formation section of the formation.

9. The method of claim 1, wherein the temperature characteristic is caused by external factors.

10. A system usable with a wellbore, comprising:

an injection system to inject and to stop injection of fluid into a formation, the formation intersected by a wellbore having an uphole section uphole of the formation and a formation section within the formation;

an observation system to observe temperature at least partially along the uphole section of the wellbore and at least partially along the formation section of the wellbore, wherein, after injection of fluid is stopped, the injection system re-starts injection of fluid into the formation, wherein the observation system observes a temperature profile of the fluid in the wellbore, wherein the observation system identifies a temperature characteristic between two points on the temperature profile, and wherein, while the injection of fluid is occurring, the observation system observes movement of the temperature characteristic as it moves from the uphole section and across the formation section of the wellbore; and a processing system to determine an inflow profile of the formation based on the movement of the temperature characteristic within the wellbore.

11. The system of claim 10, wherein the temperature characteristic is a temperature peak.

12. The system of claim 10, wherein the observation system comprises an optical fiber disposed along the wellbore to sense temperature at least partially along the uphole section of the wellbore and at least partially along the formation section of the wellbore.

13. The method of claim 10, wherein one point of the temperature characteristic is located in the uphole section of the formation and another point of the temperature characteristic is located in the formation section of the formation.

14. The method of claim 10, wherein the temperature characteristic is caused by external factors.

* * * * *